US005451010A

United States Patent [19]

Heuser

[11] Patent Number: 5,451,010

[45] Date of Patent: Sep. 19, 1995

[54] FRICTION WINDING SHAFT

[76] Inventor: Hans Heuser, 42899 Remscheid-Lüttringhausen, Garschager Heide 41, Germany

[21] Appl. No.: 173,691

[22] Filed: Dec. 23, 1993

[30] Foreign Application Priority Data

Dec. 24, 1992 [DE] Germany ..... 42 44 218.4

[51] Int. Cl.[6] ..... B65H 18/10

[52] U.S. Cl. ..... 242/530.3

[58] Field of Search ..... 242/530.3, 571.2, 571.6, 242/571.7

[56] References Cited

U.S. PATENT DOCUMENTS

| | | | |
|---|---|---|---|
| 3,817,468 | 6/1974 | Smolderen et al. | 242/530.3 |
| 4,026,488 | 5/1977 | Hashimoto | 242/571.2 |
| 4,026,491 | 5/1977 | Bostroem | 242/530.3 |
| 4,209,138 | 6/1980 | Cecchi | 242/530.3 |
| 4,218,029 | 8/1980 | Schwenzfeier et al. | 242/530.3 |
| 4,220,291 | 9/1980 | Papa | 242/530.3 |
| 4,266,737 | 5/1981 | Mastriani . | |
| 4,332,356 | 6/1982 | Damour | 242/571.2 |
| 4,461,430 | 7/1984 | Lever | 242/530.3 |
| 4,693,431 | 9/1987 | Kataoka | 242/571.2 |
| 5,137,224 | 8/1992 | Peters et al. | 242/530.3 |
| 5,279,470 | 1/1994 | Birkmann et al. | 242/530.3 |

FOREIGN PATENT DOCUMENTS

| | | | |
|---|---|---|---|
| 2421393 | 11/1974 | Germany | 242/571.7 |
| 2856066 | 7/1980 | Germany . | |
| 3918863 | 12/1990 | Germany . | |
| 58-157661 | 9/1983 | Japan | 242/571.2 |

*Primary Examiner*—John P. Darling
*Attorney, Agent, or Firm*—Cort Flint

[57] ABSTRACT

The instant invention relates to a friction winding shaft, in particular for roll cutting and winding machines with a central drive shaft (8) and fitted, adjoining rings (12) on which tubular winding cores (21) are held under pre-stress via winding core retainers 16. According to the invention, winding core supports (27, 28) which automatically press against the inside winding core surfaces (22) after the start of the winding process to provide firm support are proposed. This provides improved centering and alignment of the winding cores (21). For this purpose each ring (12) is divided concentrically into an inner friction ring (17) and an outer holding ring (18) capable of rotation relative to the former. The inner friction ring (17) is provided with a slanted guide (31, 36) through which a pressure rod (29) or a rotatable support element (32) can be extended into a position of contact against the inside winding core surface (22).

15 Claims, 3 Drawing Sheets

III-III

FRICTION WINDING SHAFT

BACKGROUND OF THE INVENTION

The present invention relates to a friction winding shaft, and, in particular to a winding shaft for roll cutting and winding machines.

Roll cutting and winding machines in which wide webs are pulled from a supply roll and are then divided into strip-shaped bands are known (German DE-OS 28 56 066). The bands are wound up on tubular cores which are placed on a friction winding shaft. To wind up the strip-shaped bands, two friction winding shafts are provided at a distance from each other so that every other strip-shaped band is wound up on one friction shaft and the strip-shaped bands in between are wound up on the second friction winding shaft.

As the strip-shaped bands are wound up, different winding diameters are produced due to differences in the thickness of the material web, so that the winding cores placed on a friction winding shaft can no longer be driven at the same rotational speeds. The drive shaft is therefore driven at a somewhat higher rotational speed than is required to wind up the strip-shaped bands. The rings placed on the drive shaft are slaved by the friction contact between the inner ring surfaces and the friction surfaces on the pressure elements, but they tend to slip slightly to compensate for the difference between the rotational drive speed and the rotational winding speed. The force of friction contact can be altered by changing the pressure in one of the inflatable hoses placed under the pressure elements.

The pressure elements are in this cases made in form of three pressure strips extending in the longitudinal sense of the drive shaft and are designed so that they can adapt, at least in the longitudinal sense, to different inside diameters of adjoining rings.

The entire effective length of the drive shaft is taken up by narrow rings immediately adjoining each other. This results in identical winding tensions in all the bands of the friction winding shaft to be wound up since each pressure strip is applied with an identical contact pressure to each inside ring surface.

The rings serving to hold the winding cores are provided with elastic projections on the outer ring surface. In particular, sheet metal springs are provided which are oriented at a slight angle relative to the radius in the direction of drive. The springs are pressed against the inside surfaces of the winding cores and function as a spring tension. As the bands are wound up, the free, edge-shaped ends of the projections press slightly into the material of the winding cores and thus constitute a slip-free connection with a winding core.

In addition, another embodiment of winding core retainers is known on the market in form of spring-loaded rotating parts used as clamping elements with projecting contact edges across from the outer holder surface. These roof-shaped contact edges are also at a slight angle to the radius in the direction of drive, and are pressed against the inside winding core surface and function as spring tension.

To remove the wound-up winding cores they are rotated in driving direction relative to the stopped rings. This is possible because this rotation is in the sense of winding core retainer slant. Rotation in this direction and lateral shifting make it possible to remove the winding cores together with the wound-up bands from the friction shaft and to install new winding cores.

The winding cores are normally made of a paper material or a plastic with relatively wide tolerances. The diameter tolerances of the inside core diameter of the winding cores are taken up by the available elastic movement of the winding core retainers, so that this available elastic movement must be sufficient.

Because of this elastically supported freedom of movement of the winding cores in relation to the rings which is necessary because of the winding core tolerances, centering and perpendicular alignment of the winding cores in relation to the drive shaft is not sufficiently precise in certain instances of application. These minor deviations may result in a upward leap and/or in minor wobbling movement which, however small, may nevertheless lead to unsatisfactory winding results under certain circumstances. A similar winding shaft is known (German DE 39 18 863 A1) where the friction rings are provided with slanted guides for the support of winding cores. The slanted guide is designed so that the winding core supports can be moved within the diameter tolerances of the cores.

Accordingly, an object of the present invention is to provide a friction winding shaft having improved centering and alignment of the installed winding cores to prevent upward leaps and wobbling of the winding cores.

SUMMARY OF THE INVENTION

The above objectives are accomplished according to the present invention by providing a friction winding shaft fitted with a plurality of rings wherein each ring is divided into two independent concentric rings, an inner friction ring and an outer holding ring. The pressure elements for friction connection with the drive shaft are applied to the inside surface of the friction ring and the winding core retainers are installed on the outer surface of the holding ring. The friction ring and the associated holding ring can be rotated relatively to each other.

At least one slanted guide is provided in the outer surface of the friction ring. At least one winding core support is provided on the holding ring and engages the slanted guide on the friction ring. The winding core support interacts in such a manner that the holding ring may be rotated relative to the friction ring in the opposite sense to which the drive shaft is driven. The winding core support can be moved beyond the outer surface of the holding ring into a pressure position against the inside core surface of an installed winding core. The slant and the length of the slanted guide are sized so that the winding core support can be moved with the existing forces at least within the range of the diameter tolerances of the winding cores used. The diameter tolerances are only a few millimeters, so that the maximum height of the slanted guide must also be sized accordingly. Furthermore the slant selected relative to an orbit must not be too steep, so that the adjustment and movement of the winding core retainer may be carried out with relatively little force.

At the beginning of a winding process, the winding cores are placed on the friction shaft and are held in position under pre-stress by the winding core retainers, whereby centering and lateral alignment may not yet be optimal. When the drive shaft begins to rotate after the start, the friction ring is rotated at the same time in the same direction through frictional interlocking. The holding ring with the installed winding core is held back by the tension pull exerted on the band which has already been applied, causing the friction ring to rotate first in the rotational drive sense relative to the holding ring. The constrained control of the winding core supports via the slanted guides on the friction rings is thereby actuated in such manner that the winding core supports are moved beyond the outer holding ring surfaces until they come into a contact position against the inside winding core surfaces. Their constrained movement is thereby stopped, and at the same time an intimate closure is created between the friction ring and holding ring, so that the two rings then continue to rotate together in the same rotational drive sense.

This firm winding core support (as compared with the known elastic support of the winding cores on the elastic or spring-loaded winding core retainers) provides improved and movement-free adjustment of the winding cores on the friction winding shaft. The actuation and movement of the winding core supports is in this case automatic when a winding process starts.

If long winding cores are used, these cover several holding rings. These several holding rings are not coupled in their rotational position by the sliding clutch via the pressure elements and the mutual free rotatability. They adjust themselves differently in their rotational position in relation to each other. If only one winding core support is installed on a holding ring, winding core supports for several adjoining holding rings distributed over the entire angle of rotation are present, so that improved centering and alignment is achieved. Preferably three winding core supports, offset over the circumference, be provided on one holding ring. If winding core supports and the slanted surfaces are of identical form, an even, radially aligned movement of the offset winding core supports results. A uniform enlargement of the effective circle of contact is provided for the winding core. This enlargement is precisely related to the center of the drive shaft. Precise centering and alignment of relatively narrow winding ores is also possible with this embodiment.

One embodiment of a winding core support consists of a pressure rod held in a radial guide which penetrates the holding ring. Depending on the position of the slanted guide, the pressure rod may be moved outward to a greater or lesser extent, beyond the outer holding ring surface.

In another embodiment, the winding core support consists of a rotation support element mounted rotatably on a holding ring and penetrating the holder. This rotation support element may be made in the form of a bell crank, with one crank arm engaging the sloped guide and the other crank arm being swivelled out beyond the outer holding ring surface to a contact position against the inside winding core surface as the holding ring rotates relative to the friction ring.

The slanted guide on the friction ring may be made in form of an easily produced slanted surface on the outer surface of the friction ring. The winding core support, in particular a pressure rod, can then slidingly directly engage such a slanted surface. A return to the retracted position may be effected advantageously via a pull-back spring.

The slanted guide is also possible in addition or as an option in form of a slide guide, whereby the extension and retraction of the winding core support is effected necessarily by a sliding connection between a guiding element of the winding core support and the slide guide. No pull-back spring is required in this case.

A support in the form of a point or a small surface for the winding cores via suitably designed winding core supports results in improved centering and alignment of the winding cores. Particularly advantageous results are achieved if the support is through a relatively large-surface contact element in form of an arc of circle, in form of a shell, towards the inner core surface and having a configuration conforming to the inner winding core surface. Good, positive-locking contact is achieved if the shell element is made of a flexible sheet metal with a radius that is slightly greater than that of an inside diameter of a winding core. The spring force of the flexible sheet metal should be selected so that the force exerted upon the winding core retainer suffices to deform the flexible sheet metal so that it applies itself against the inside winding core surface. This is also possible if the shell element is part of a rotatably mounted support element or if a shell element is connected near the center to a pressure rod.

The utilization of shell elements involves the risk that these may rotate in relation to a radial surface and thus become caught on adjoining rings. This may cause the entire winding function, which relies in particular on free rotatability of the rings in relation to each other, to be disturbed. To avoid this, a rotation safety is provided for the winding core supports. If shell elements are used, it can be designed with the ends of these shell elements bent towards the central drive shaft and thin shims installed in the ring diameter. When the winding core retainers or shell elements are now moved or swivelled out beyond the outer ring diameter and into a contact position, the bent shell element ends are still located near the outer shim edge. A rotation relative to a radial plane and relative to support rings is prevented by the shim support from becoming caught in an adjoining ring.

An alternate rotation safety may easily be achieved with the utilization of a pressure rod by holding the latter prismatically, i.e. not cylindrically, in a prismatic guide with a corresponding configuration. To install a pull-back spring easily and effectively on a pressure rod, a window is provided in the appertaining guide element through which the pull-back spring, preferably made of spring wire, can be connected to the pressure rod.

To remove and install new winding cores it is necessary to return the winding core supports to their retracted starting position. This may be effected in particular with spring-loaded pressure rods by means of a back-sliding movement on the slanted guide in combination with a rotation of the holding ring relative to the friction ring. The reverse-rotation force may however be relatively low if the slanted guide angle is small, so that inhibitions may appear, making manual return necessary. To ensure reliable return of the winding core support a return spring may be installed between the holding ring and the friction ring in such manner that it provokes a rotation of the holding ring relative to the friction ring in the sense of drive. The spring force of the pull-back spring is selected so as to be less than the force between holding ring and friction ring produced by the band tension during the winding process. In this manner, the relative rotation between the holding ring and friction ring is made possible during the winding process in order to move the winding core retainer.

It may also be advantageous with embodiments of a friction winding shaft with winding core retainers according to the invention to make the pressure elements in form of pressure pads extending in the longitudinal direction of the drive shaft, with at least three being provided on the circumference, offset in relation to each other. The pressure pads should adapt themselves at least in the longitudinal sense to different inside diameters of adjoining friction rings. The pressure pads are controlled in a known manner by inflatable hoses placed in receiving spaces beneath the pressure pads.

Preferably, the entire active length of the drive shaft should be occupied by rings of narrow width, making it possible to easily use winding cores with different widths. When shell elements are used on the winding core retainers, these are advantageously made in the same width as the rings in order to provide the largest possible contact surface. The winding core retainers are preferably offset in relation to the winding core supports and located between the latter. The winding core retainers are also known, spring-loaded rotating elements in form of clamping bodies with contact edges projecting beyond the outer holding ring surface.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
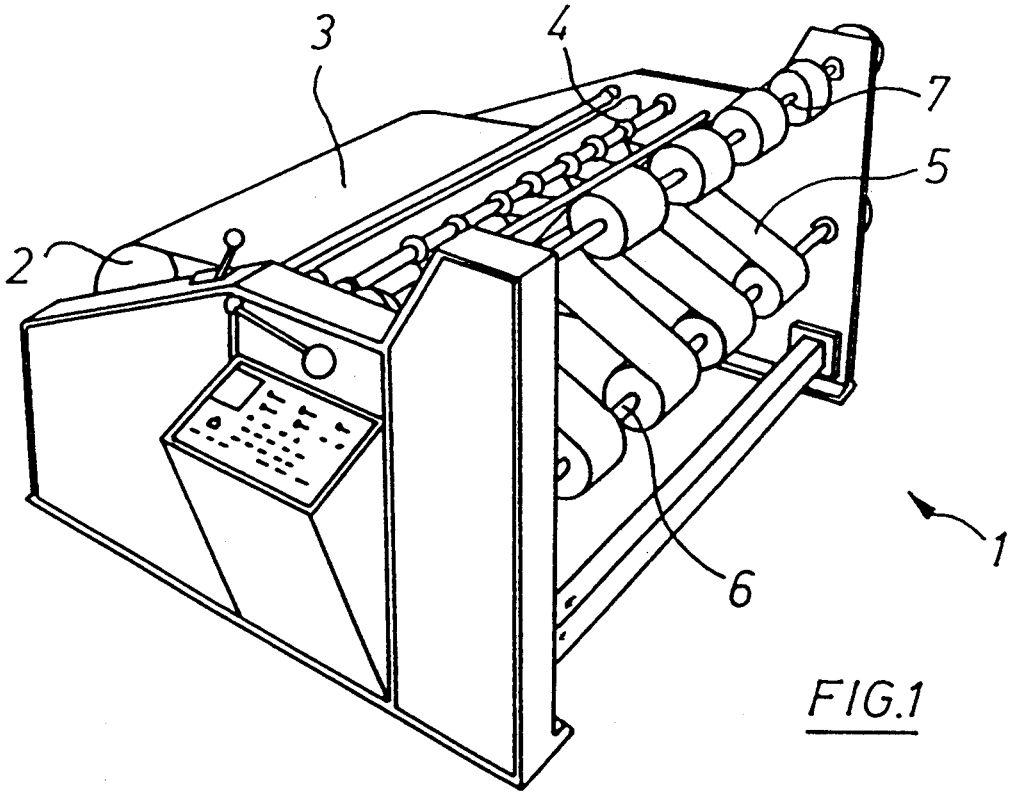
FIG. 1 shows a perspective view of a roll cutting and winding machine.

Referring now in more detail to the drawings, FIG. 1 shows a roll cutting and winding machine 1 in which a wide material web 3 is pulled from a supply roll 2, and is cut and divided into eight adjoining, strip-shaped bands 5. In the same operation the bands 5 are wound up by means of friction winding shafts 6, 7, so that one band is wound up on the friction winding shaft 6 and the adjoining band on friction winding shaft 7.

Figure 2:
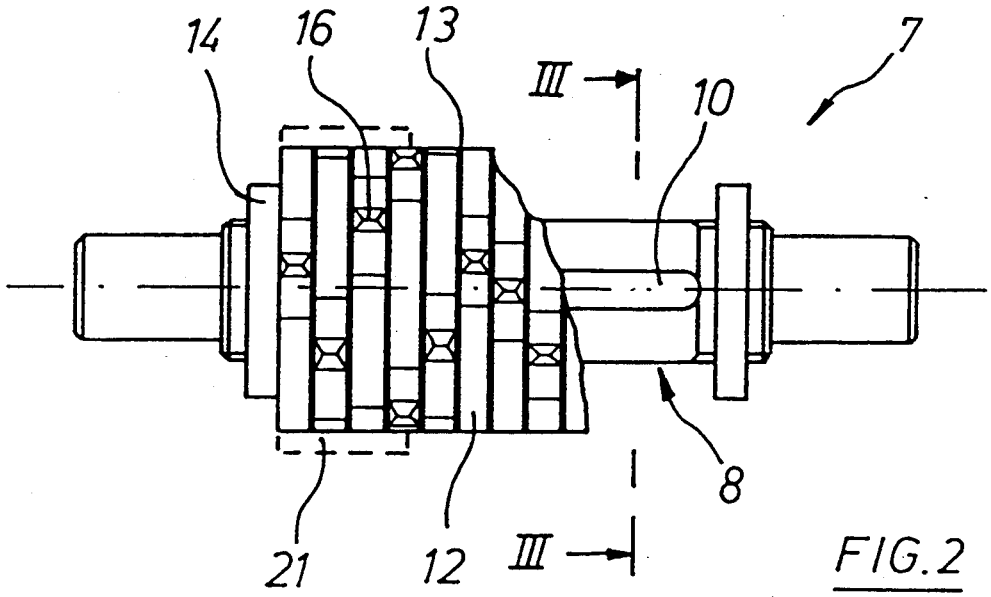
FIG. 2 shows a friction winding shaft according to the invention, in a side view and in part broken off.
Figure 3:
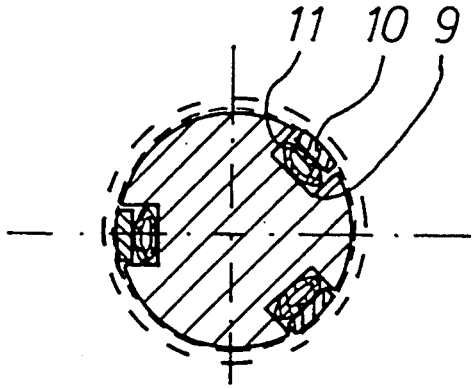
FIG. 3 shows a section through the drive shaft along line III—III of FIG. 2.

The friction winding shaft 7 is shown in greater detail in FIGS. 2 and 3. The friction winding shaft 7 consists of a central drive shaft 8 with three longitudinal grooves 9 offset over the circumference, each containing a pressure pad 10 pointing outward and a resilient, inflatable hose 11.

Figure 5:
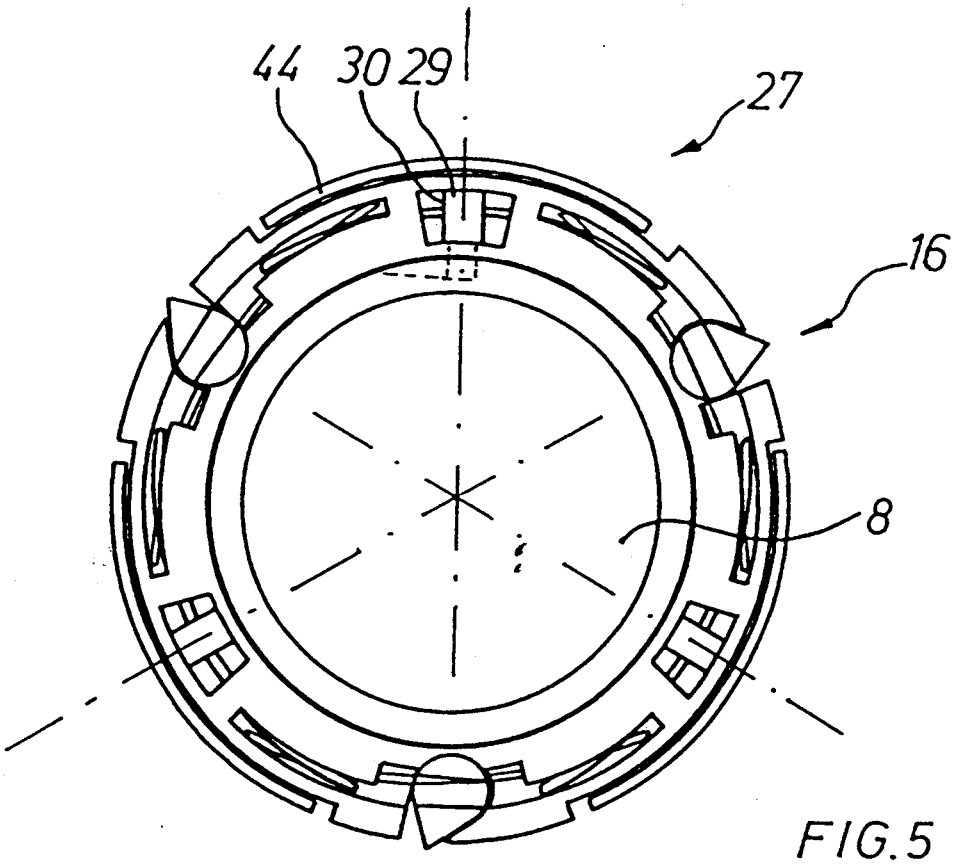
FIG. 5 shows a side view of a ring with retracted winding core retainer.
Figure 6:
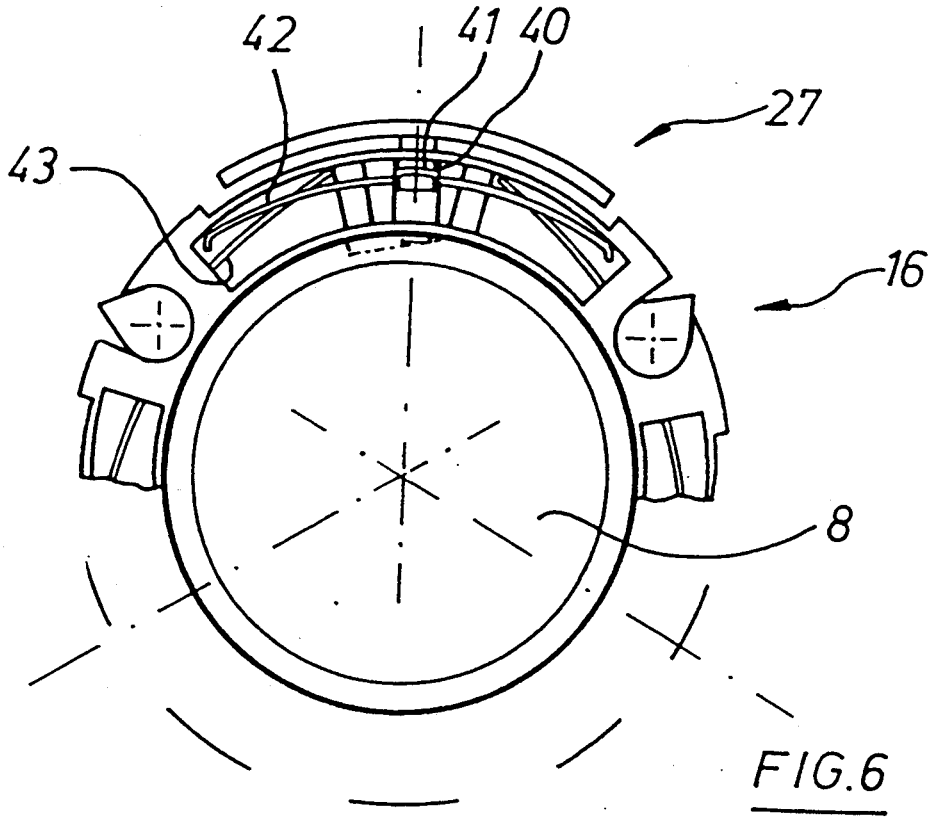
FIG. 6 shows a side view according to FIG. 5 of the other side, with extended winding core retainer.

Rings 12 are placed on the drive shaft 8 and are shown in detail and more precisely in FIGS. 5 and 6. Thin shims 13 are inserted in the outer diameter of the rings 12. The rings 12 are in tight contact with each other via the shims 13, are rotatable and are held together in axial direction by laterally mounted end pieces 14. Tubular winding cores 21 are placed on the rings 12 and are held by means of pre-stressed winding core retainers 16. The rings 12 are so narrow that generally several rings 12 are covered by one winding core 21.

Figure 4:
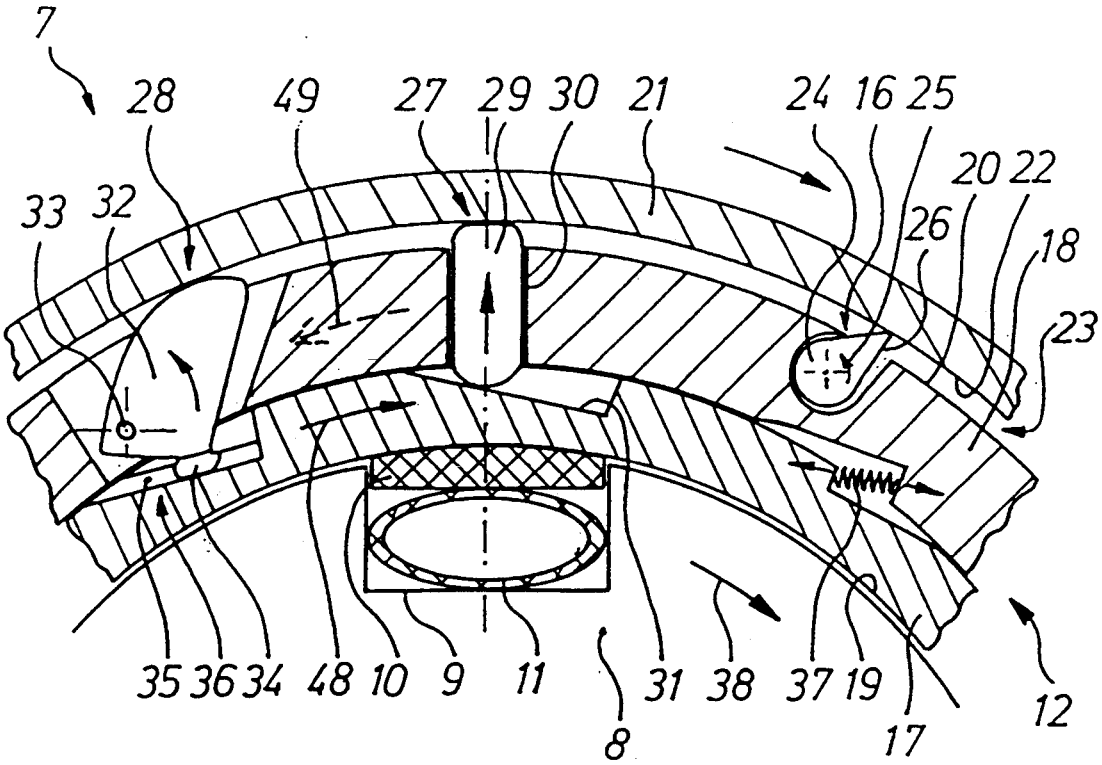
FIG. 4 shows a basic diagram of a winding core retainer in two alternative embodiments.

The basic diagram drawing of FIG. 4 shows a partial cross-section through the friction winding shaft 7 with a cross-section through an installed ring 12. A longitudinal groove 9 with installed pressure pad 10 and inflatable hose 11 is shown in the drive shaft 8. The ring 12 is divided concentrically into two independent rings, an inner friction ring 17 and an outer holding ring 18, which are able to rotate relative to each other (arrows 48, 49). The pressure pad 10 is pressed against the inside friction ring surface 19. Offset over the circumference, the winding core retainers 16 are provided on the outside holding ring surface 20.

A tubular winding core 21 having an inside diameter that is slightly larger than the outside diameter of ring 12 is placed on the holding ring 18. A clearance space 23 with a tolerance results between outside holding ring surface 20 and inside winding core surface 22. The winding core retainer 16 consists of a spring-loaded rotating part acting as the clamping element 24 (arrow 25 shows the direction of the spring force). The clamping element 24, under the influence of spring pre-stress, presses with a roof-shaped edge 26 against the inside winding core surface 22 and thus bridges the clearance 23.

To provide a firm support for the winding core 21 by bridging the clearance 23, the winding core supports 27, 28 are distributed over the circumference. The winding core support 27 consists of a pressure bolt 29 which is capable of movement within a radial guide 30 on the holding ring 18. With its inside end the pressure bolt 29 bears upon a sloped surface 31 which extends at an angle to the outer friction ring surface.

The (alternative) winding core support 28 consists of a rotatable support element 32 which is rotatably mounted on the holding ring 18 (rotational axis 33) and which engages a slanted slide guide 36 with a cast-on guiding element 34. A reverse-rotation spring 37 is provided between the friction ring 17 and the holder, and is shown in the form of a spiral compression spring.

In operation, at the beginning of a winding process (FIG. 4), the winding cores 21 are placed on the rings 12, and the winding cores being pushed and twisted to the right. This causes the edges 26 of the winding core retainer 16 which are at an angle relative to a radius to be swivelled towards the outside holding ring surface 20 to facilitate installation of the winding cores 21. The plurality of winding core retainers 16 are offset over the circumference, and hold the winding cores 21 in the shown position with clearance 23. The bands to be wound up are now attached to the winding cores 21 and the drive shaft 8 is started in the direction of drive according to arrow 38. Simultaneously the inflatable hose 11 has already been inflated, causing the pressure pad 10 to come into frictional contact with the friction ring 17, so that the friction ring, together with the drive shaft 8, rotates in the sense of arrow 48.

At the onset of operation, the holding ring 18 is rotated further to the right relative to the shown position (FIG. 4), so that the pressure bolt 29 and the guiding element 34 lie at the deepest point of the sloped surface 31 or the slide guide 36. The pressure bolt 29 and the rotatable support element 32 do not protrude beyond the outside holding ring surface 20 at that moment, so that they do not interfere in the installation of the winding cores 21. Because of the free rotatability between the friction ring 17 and the holding ring 18, the latter is not slaved immediately after the start of the drive shaft 8. Due to the counter-pull of the applied bands the holding ring lags behind the rotational movement of the friction ring (arrow 48), as is indicated by the segmented arrow 49. As a result the sloped surface 31 or the slide guide 36 below the pressure bolt 29 which is immovably guided on the holding ring or the rotatable support element 32 are moved in such manner that a constrained movement is carried out until the pressure bolt 29 or the rotatable support element 32 come into contact position against the inside winding core surface 22. As a result the clearance 23 is firmly bridged (and not elastically, as via winding core retainer 16), so that precise centering and alignment of the winding cores 21 result. Furthermore the firm coupling between the friction ring 17 and the holding ring 18 is then established in direction of drive, so that the winding cores 21 then also rotate in the direction of drive (arrow 39).

When the winding cores 21 are to be removed together with wound-up bands, the bands are cut off so that the band traction is eliminated. A reverse rotation between friction ring 17 and holding ring 18 is then effected via pull-back spring 37, so that the (spring-loaded) pressure bolt 29 and the rotatable support element 32 are returned to their starting positions.

FIGS. 5 and 6 show a concrete embodiment of a ring 12 in two side views, each with three offset and modified winding core supports 27. The pressure bolt 29 is held in a tubular guide 30 which has a window 40 on one side. In this window 40, in a slit 41 in the pressure bolt 29, a pull-back spring 42 in form of a spring wire is inserted. In addition, reverse-rotation springs 43 (arrow 25 in FIG. 6) for the winding core retainers are made of spring wire. At the outer end of the pressure bolt 29 a plane contact element in form of a shell element 44 of the same width as ring 12 (see FIG. 5) is fixedly attached. The curvature is approximately identical with the outer holding ring surface. Three winding core supports 27 are provided at an angular distance of 120° from each other, with a winding core retainer 16 in every space between them. The outer holding ring surface between the winding core retainers 16 is constituted to the greatest extent by the adjustable shell elements 44, so that an enlargement of the effective circle of contact for the winding cores 21 is achieved through them.

Figure 7:
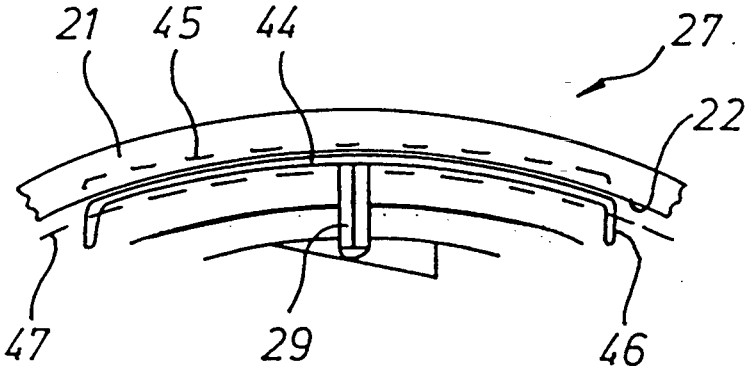
FIG. 7 shows a basic diagram of a winding core retainer with rotation safety.

FIG. 7 shows another modified embodiment of a winding core support 27 in a basic diagram. The shell element 44 is in this case made of an spring-sheet metal with a curvature (broken line 45) that is greater than the inside winding core surface 22. Under load, the shell element 44 then presses flat against the inside winding core surface 22. The ends of the shell element 44 are bent over into stops 46 to serve as rotation safeties in the extended position, and these stops 46 lie within the surface of the shims 13 (represented by the segmented circular line 47), even in an extended state. A prismatic-shaped pressure bolt 29 is used which can only be displaced in a linear manner, cannot be rotated. The prismatic pressure bolt is held in a guide (not shown) of corresponding configuration is represented as another rotation safety.

In conclusion it can be said that considerable improvement in the centering and alignment of winding cores on friction winding shafts can be achieved with the instant invention.

While a preferred embodiment of the invention has been described using specific terms, such description is for illustrative purposes only, and it is to be understood that changes and variations may be made without departing from the spirit or scope of the following claims.

What is claimed is:

1. A friction winding shaft for a roll cutting and winding machine, said machine having a central, elongated drive shaft with movable and controllable pressure elements installed in recesses formed in a circumference of said drive shaft; a plurality of rings fitted on said drive shaft and adjoining each other, said pressure elements pressing against the inside surfaces of said rings for friction contact; winding core retainers distributed over a circumference of said ring which protrudes elastically beyond outer surfaces of said rings for the reversible retention and non-rotatable coupling of tubular winding cores installed on said rings, said winding cores winding up bands; and said winding cores having inside diameter tolerances in which said winding core retainers move under spring action, wherein said friction winding shaft comprises:

a plurality of rings surrounding said drive shaft which include inner friction rings and concentric, outer holding rings;

a plurality of pressure elements pressing against an inside surface of said friction rings;

said winding core retainers being installed on an outside surface of said holding rings;

said friction rings and said associated holding rings being rotatable relative to each other;

at least one sloped guide provided at said outside surface of said friction ring;

at least one winding core support movably carried on said holding rings which engages said sloped guide in such a manner that, when said holding ring is rotated relative to said friction ring in an opposite direction of said drive shaft, said winding core support can be moved beyond said outside surface of said holding rings into a contact position against an inside winding core surface of an installed winding core;

said sloped guide having a slant and length so that said winding core supports can be moved at least within said inside diameter tolerances of said winding cores; and said sloped guides include slanted surfaces, and moveable guide elements engaging said slanted surfaces which press against said winding core supports.

2. The apparatus of claim 1 including three winding core supports disposed around said circumference of said holding rings.

3. The apparatus of claim 1 wherein said winding core supports include a pressure rod which is held in a guide for radial movement relative to said holding rings.

4. The apparatus of claim 3 including a radial guide for said pressure rods and windows formed in said radial guides through which a pull-back spring is received for connection of said pressure rods.

5. The apparatus of claim 1 wherein said winding core supports include rotatable support elements which are rotatably carried by said holding rings.

6. The apparatus of claim 1 wherein said pressure elements include pressure pads extending in the longitudinal direction of said drive shaft, said pressure pads being offset over a circumference and are adapted to different inside diameters of adjoining friction rings, and said pressure pads are actuated by inflatable hoses placed in receiving spaces in said drive shaft.

7. The apparatus of claim 1 wherein generally an entire effective length of said drive shaft is occupied by said rings.

8. The apparatus of claim 1 wherein said winding core retainers carried on said outer holding rings surfaces include spring-loaded clamping elements having contact edges projecting beyond said outside holding ring surface; said clamping elements are aligned in direction of drive of said drive shaft at a slight angle relative to a radius of said holding rings and press against said inside winding core surface under a biasing pressure.

9. A friction winding shaft for a winding machine having a central drive shaft, said friction winding shaft comprising:

a plurality of pressure elements carried by said drive shaft;

a plurality of drive rings carried by said drive shaft in contact with said pressure elements;

said drive rings including inner friction rings and outer concentric holding rings, said pressure elements pressing against an inside surface of said friction ring;

said friction rings and associated holding rings being rotatable relative to each other;

a plurality of winding core retainers carried by said holding rings for engaging a winding core fitted on said winding shaft;

a plurality of winding core supports carried on said outer rings;

said winding core retainers and winding core supports being alternating and circumferentially spaced around said outer holder rings;

an actuator for actuating said winding core support so that said friction ring, holder ring, and winding core are rotated together in a drive direction of said drive shaft; and said winding core supports including a pressure rod which is held in a guide for radial movement relative to said holding rings.

10. A friction winding shaft for a roll cutting and winding machine, said machine having a central, elongated drive shaft with movable and controllable pressure elements installed in recesses formed in a circumference of said drive shaft; a plurality of rings fitted on said drive shaft and adjoining each other, said pressure elements pressing against the inside surfaces of said rings for friction contact; winding core retainers distributed over a circumference of said ring which protrudes elastically beyond outer surfaces of said rings for the reversible retention and non-rotatable coupling of tubular winding cores installed on said rings, said winding cores winding up bands; and said winding cores having inside diameter tolerances in which said winding core retainers move under spring action, wherein said friction winding shaft comprises:

a plurality of rings surrounding said drive shaft which include inner friction rings and concentric, outer holding rings;

a plurality of pressure elements pressing against an inside surface of said friction rings;

said winding core retainers being installed on an outside surface of said holding rings;

said friction rings and said associated holding rings being rotatable relative to each other;

at least one sloped guide provided at said outside surface of said friction ring;

at least one winding core support movably carried on said holding rings which engages said sloped guide in such a manner that, when said holding ring is rotated relative to said friction ring in an opposite direction of said drive shaft, said winding core support can be moved beyond said outside surface of said holding rings into a contact position against an inside winding core surface of an installed winding core;

said sloped guide having a slant and length so that said winding core supports can be moved at least within said inside diameter tolerances of said winding cores; and said winding core supports including contact elements in form of an arc which press against said inside winding core surface and generally conform to the shape of said inside winding core surface.

11. The apparatus of claim 10, wherein said contact elements include a shell element made of spring sheet metal having a radius of curvature which is slightly larger than a radius of curvature of said inside winding core surface.

12. The apparatus of claim 11 wherein said shell elements include bent ends which are bent towards said central drive shaft, and including a plurality of shims disposed between said rings.

13. A friction winding shaft for a roll cutting and winding machine, said machine having a central, elongated drive shaft with movable and controllable pressure elements installed in recesses formed in a circumference of said drive shaft; a plurality of rings fitted on said drive shaft and adjoining each other, said pressure elements pressing against the inside surfaces of said rings for friction contact; winding core retainers distributed over a circumference of said ring which protrudes elastically beyond outer surfaces of said rings for the reversible retention and non-rotatable coupling of tubular winding cores installed on said rings, said winding cores winding up bands; and said winding cores having inside diameter tolerances in which said winding core retainers move under spring action, wherein said friction winding shaft comprises:

a plurality of rings surrounding said drive shaft which include inner friction rings and concentric, outer holding rings;

a plurality of pressure elements pressing against an inside surface of said friction rings;

said winding core retainers being installed on an outside surface of said holding rings;

said friction rings and said associated holding rings being rotatable relative to each other;

at least one sloped guide provided at said outside surface of said friction ring;

at least one winding core support movably carried on said holding rings which engages said sloped guide in such a manner that, when said holding ring is rotated relative to said friction ring in an opposite direction of said drive shaft, said winding core support can be moved beyond said outside surface of said holding rings into a contact position against an inside winding core surface of an installed winding core;

said sloped guide having a slant and length so that said winding core supports can be moved at least within said inside diameter tolerances of said winding cores; and a turn-back spring installed between said holding ring and said friction ring in such manner that a rotation of said holding ring relative to the friction ring is created in a direction of drive shaft rotation, and a spring force of said pull-back spring is sized so as to be lower than a force between said holding ring and said friction ring produced by a tension during the winding process.

14. A friction winding shaft for a machine having a central drive shaft, said friction winding shaft comprising:

a plurality of pressure elements carried by said drive shaft;

a plurality of drive rings carried by said drive shaft in contact with said pressure elements;

said drive rings including inner friction rings and outer concentric holding rings, said pressure elements pressing against an inside surface of said friction ring;

said friction rings and associated holding rings being rotatable relative to each other;

a plurality of winding core retainers carried by said holding rings for engaging a winding core fitted on said winding shaft;

a plurality of winding core supports carried on said outer rings;

said winding core retainers and winding core supports being alternating and circumferentially spaced around said outer holder rings;

an actuator for actuating said winding core support so that said friction ring, holder ring, and winding core are rotated together in a drive direction of said drive shaft; and said winding core supports include contact elements in form of an arc which press against said inside winding core surface and generally conform to the shape of said inside winding core surface.

15. The apparatus of claim 14 wherein said contact elements include a shell element made of spring sheet metal having a radius of curvature which is slightly larger than a radius of curvature of said inside winding core surface.

* * * * *